US010967671B2

(12) United States Patent
Hannig

(10) Patent No.: US 10,967,671 B2
(45) Date of Patent: Apr. 6, 2021

(54) DECORATED SURFACE-STRUCTURED WALL OR FLOOR PANEL

(71) Applicant: Akzenta Paneele + Profile GMBH, Kaisersesch (DE)

(72) Inventor: Hans-Jürgen Hannig, Bergisch Gladbach (DE)

(73) Assignee: Akzenta Paneele + Profile GMBH, Kaisersesch (DE)

( * ) Notice: Subject to any disclaimer, the term of this patent is extended or adjusted under 35 U.S.C. 154(b) by 0 days.

(21) Appl. No.: 16/462,786

(22) PCT Filed: Jan. 10, 2018

(86) PCT No.: PCT/EP2018/050580

§ 371 (c)(1),
(2) Date: May 21, 2019

(87) PCT Pub. No.: WO2018/130580

PCT Pub. Date: Jul. 19, 2018

(65) Prior Publication Data

US 2019/0366757 A1 Dec. 5, 2019

(30) Foreign Application Priority Data

Jan. 11, 2017 (EP) ..... 17151000

(51) Int. Cl.
*B44C 5/04* (2006.01)
*B44C 1/24* (2006.01)

(52) U.S. Cl.
CPC ..... *B44C 5/04* (2013.01); *B44C 1/24* (2013.01); *B44C 5/043* (2013.01); *B44C 5/0438* (2013.01); *B44C 5/0461* (2013.01)

(58) Field of Classification Search
CPC .. B44C 1/24; B44C 5/04; B44C 5/043; B44C 5/0438; B44C 5/0461
See application file for complete search history.

(56) References Cited

U.S. PATENT DOCUMENTS

2014/0237925 A1 8/2014 Hannig

FOREIGN PATENT DOCUMENTS

| | | | |
|---|---|---|---|
| DE | 202011107844 | U1 | 2/2013 |
| DE | 102012022461 | A1 | 5/2014 |
| EP | 2829415 | A1 | 1/2015 |
| EP | 2927017 | A1 | 10/2015 |
| WO | 2012001109 | A1 | 1/2012 |

*Primary Examiner* — Lawrence D Ferguson
(74) *Attorney, Agent, or Firm* — Harness, Dickey & Pierce, P.L.C.

(57) ABSTRACT

The disclosure relates to a decorated, surface-structured wall or floor panel and a method for manufacturing same. The decorated, surface-structured wall or floor panel of the disclosure comprises a substrate made of a plastic composite material, a primer coat on a surface of the substrate, a decorative coat on the primer coat, a coat of radiation-curable varnish on the decorative coat, a structured plastic film on the coat of radiation-curable varnish, and a coat of finishing varnish on the structured plastic film.

14 Claims, 1 Drawing Sheet

DECORATED SURFACE-STRUCTURED WALL OR FLOOR PANEL

CROSS-REFERENCE TO RELATED APPLICATIONS

This application is a National Stage of International Application No. PCT/EP2018/050580 filed on Jan. 10, 2018. This application claims the priority to European Patent Application No. 17151000.1, filed on Jan. 11, 2017. The entire disclosures of the above applications are incorporated herein by reference.

FIELD

The present disclosure relates to a decorated and surface-structured wall or floor panel. The present disclosure further relates to a method for producing a decorated and surface-structured wall or floor panel. The present disclosure in particular relates to a decorated and surface-structured wall or floor panel based on a direct printed composite carrier.

BACKGROUND

This section provides background information related to the present disclosure which is not necessarily prior art.

Decorated panels are known per se, wherein the term wall panel also means panels which are suitable as a ceiling or door lining. They usually consist of a carrier or core of a solid material, such as a wood material, which is provided on at least one side with a decorative layer and a covering layer and optionally with further layers, such as a wearing layer disposed between the decorative and the covering layer. The decorative layer is usually a printed paper impregnated with a resin or a printing layer applied onto the carrier by use of, for example, a suitable printing subsurface.

A method for producing a decorated wall or floor panel is known from the document EP 2 829 415 A1, in which, starting from a granular carrier material, a carrier and subsequently a panel are formed. In such a method, for example, a WPC can be used as a carrier material.

Here, the production of the panels as well as the panels themselves in some circumstances can still offer room for improvement. Potential for improvement may in particular be provided with regard to the applicability at the site of the end user.

In order to improve the realistic impression of the panels, it is known from the prior art to provide them with a surface structure in order to achieve a haptic effect adapted to a natural material. Here, it may be provided, for example, that in a wood decoration the structure of the grain is formed by a surface structure matching with the visual representation of the wood grain.

SUMMARY

This section provides a general summary of the disclosure, and is not a comprehensive disclosure of its full scope or all of its features.

It is therefore the object of the present disclosure to provide a surface-structured decorated wall or floor panel which enables an improved applicability while providing good properties. Moreover, it is the object of the present disclosure to provide a method for producing a surface-structured decorated wall or floor panel based on a direct printed composite carrier.

This object is achieved by a decorated and surface-structured panel comprising the features of claim 1. This object is further achieved by a method comprising the features of claim 11. Preferred embodiments of the disclosure are set forth in the dependent claims, in the description or in the figures, wherein further features described or shown in the dependent claims or in the description or in the figures may individually or in any combination constitute a subject of the disclosure, if the opposite is not clearly obvious from the context.

In the sense of the present disclosure, a composite carrier is a sheet obtained from a suitable plastic with the addition of a filler or a solid material. Here, the filler or the solid material may be both of organic nature such as plant fibers or flour, animal fibers such as animal hair, wood fibers or flour, and of inorganic nature such as of mineral nature. Examples thereof are stone flour, mineral fibers or glass fibers. Likewise, synthetic fibers can be included as filler.

By the disclosure, a decorated and surface-structured wall or floor panel is provided, comprising a carrier made of a plastic composite material, a primer layer disposed on a surface of the carrier plate, a decorative layer disposed on the primer layer, a layer of a radiation-curable varnish disposed on the decorative layer, a structured plastic film disposed on the layer of a radiation-curable varnish, and a topcoat layer disposed on the structured plastic film.

The term "decorated wall or floor panel" or "decorative panel" in the sense of the disclosure means in particular wall, ceiling, door or floor panels comprising a decoration which replicates a decorative template and is applied onto a carrier plate. Decorative panels are used in a variety of ways, both in the field of interior design of rooms, as well as a decorative cladding of buildings, for example in exhibition stand construction. The decorative panels often comprise a decoration that is intended to replicate a natural material.

Examples of such replicated natural materials or decorative templates are wood species such as maple, oak, birch, cherry, ash, walnut, chestnut, wenge or even exotic woods such as Panga-Panga, mahogany, bamboo and bubinga. In addition, often natural materials such as stone surfaces or ceramic surfaces are replicated.

Accordingly, a "decorative template" in the sense of the present disclosure in particular means such an original natural material or at least a surface of such a material, which is to be imitated or replicated by the decoration.

A "carrier" may in particular be understood as a layer serving as a core or as a base layer in a finished panel. For example, the carrier may already impart an appropriate stability to the panel or contribute thereto.

Accordingly, a carrier material can be understood as a material which forms the carrier at least to a predominant part. In particular, the carrier can consist of the carrier material.

The carrier material may comprise, for example, a plastic-containing matrix material in which a solid material or a filler having a particle size of less than or equal to 800 μm, preferably of less than or equal to 600 μm, is embedded.

The matrix material serves in particular to accommodate or embed the solid material in the finished carrier. The matrix material in this case comprises a plastic or a plastic mixture.

Depending on the desired field of application and the desired properties of the panel, the proportions of matrix material or solid material may be selectable. As a result, a good adaptability to the desired field of application can be enabled. In principle, however, it may be preferred that the proportion of the solid material is greater than or equal to the proportion of the matrix material.

Examples of plastics which may preferably serve as matrix material include in particular thermoplastic materials, for example polyethylene or polypropylene or mixtures of the aforementioned plastics. It may further be preferred that the matrix material comprises polypropylene, such as in the form of LDPE, wherein the polypropylene may comprise a mixture of a homopolymer and a copolymer. In particular, a mixture of a homopolymer and a copolymer may provide particularly advantageous properties for the matrix material in that, for example, they can be formed into a carrier in a range of 180° C. to 200° C., so that a particularly effective process control, for example with exemplary line speeds in a range of 6 m/min, can be enabled. Furthermore, the matrix material may in principle be free of a bonding agent.

As a copolymer, for example, a copolymer can be used, which is composed of, for example, propylene and ethylene as monomer units, for example consists thereof, wherein the density of the copolymer may be greater than or equal to the density of the homopolymer.

By use of a homopolymer, in particular, a high melt flow rate can be enabled, wherein the melt flow rate of the homopolymer may in particular be greater than that of the copolymer. This can enable a particularly good formability of the carrier during the manufacturing process. Furthermore, the homopolymer can thereby enable a particularly good embedding of the solid material. In contrast, the copolymer can in particular serve the mechanical strength of the carrier material or of the carrier, since a copolymer often has a comparatively high hardness, in particular with respect to the homopolymer.

With respect to the distribution of homopolymer and copolymer, it may be preferable that the homopolymer with respect to the polypropylene is present in a proportion of ≥10 wt.-% to ≤40 wt.-%, for example in a proportion of ≥20 wt.-% to ≤30 wt.-%, such as in a proportion of ≥23 wt.-% to ≤28 wt.-%, and/or that the copolymer with respect to the polypropylene is present in a proportion of ≥60 wt.-% to ≤90 wt. %, such as in a proportion of ≥70 wt.-% to ≤80 wt.-%, for example in a proportion of ≥72 wt.-% to ≤76 wt.-%, in particular wherein the polypropylene consists of the homopolymer and the copolymer.

With respect to the solid dispersed in the matrix material, it has a particle size of less than 800 μm, preferably less than 600 μm. As a result, the solid can be distributed very finely in the matrix material. The solid may, for example, be a wood material such as wood flour, or another material, such as a component of the rice plant, such as the rice spelt, the rice stem and the rice husk, cellulose or a mineral material, such as stone flour, chalk or other inorganic mineral materials. It may be particularly preferred if the solid is formed from talcum, for example consists thereof. In principle, the solids may, without being limited thereto, be present in the form of shreds, chips, flour or grains, for example in the form of a powder.

With regard to the use of wood as a solid, it is therefore possible to design a so-called WPC carrier which is basically known and has great acceptance. Thus, in particular in this embodiment, a carrier according to the disclosure can be obtained by a modification of known products.

With regard to the use of talcum as a solid, it may be advantageous that, in particular in this embodiment, a high stability is achieved. In addition, such a carrier material can enable an improved moisture resistance, in particular with a reduced moisture or heat-induced swelling. Talcum is understood in a manner known per se as a magnesium silicate hydrate, which may have, for example, the chemical formula $Mg_3[Si_4O_{10}(OH)_2]$. It may be preferred, when the specific surface density according to ISO 4352 (BET) of the talcum particles is in a range from ≥4 $m^2/g$ to ≤8 $m^2/g$, such as in a range from ≥5 $m^2/g$ to ≤7 $m^2/g$. Furthermore, it may be advantageous, if talcum is present at a bulk density according to DIN 53468 in a range from ≥0.15 $g/cm^3$ to ≤0.45 $g/cm^3$, such as in a range from ≥0.25 $g/cm^3$ to ≤0.35 $g/cm^3$. It can preferably be provided that talcum is present in the form of particles having a particle size $D_{50}$ in a range from ≥3 μm to ≤6 μm, preferably in a range of ≥4 μm to ≤5 μm, such as 4.5 μm, and/or that talcum is present in the form of particles having a particle size $D_{98}$ in the range of ≥10 μm to ≤30 μm, preferably in a range of ≥15 μm to ≤20 μm, such as 17 μm. In order to determine the particle size distribution, basically the generally known methods, such as laser diffractometry, can be used, by means of which particle sizes in the range of a few nanometers up to several millimeters can be determined. By means of this method it is also possible to determine $D_{50}$ and $D_{98}$ values which respectively state that 50% ($D_{50}$) or 98% ($D_{98}$) of the measured particles are smaller than the respective specified value.

In a particularly preferred embodiment, it may be advantageous that the solid material is formed by talcum to at least 50 wt.-%, such as at least 80 wt.-%, in particular at least 90 wt.-%, for example, at least 99 wt.-% based on the solid material, wherein the matrix material, based on the carrier material, is present in an amount from ≥20 wt.-% to ≤70 wt.-%, for example from ≥30 wt.-% to ≤55 wt.-%, and wherein the solid material, based on the carrier material, is present in an amount from ≥30 wt. % to ≤80 wt.-%, for example from ≥40 wt.-% to ≤65 wt.-%, and wherein the carrier material and the solid material together, based on the carrier material, are present in an amount from ≥90 wt.-%.

Thus, it may be advantageous that the carrier material consists to a large extent of the solid material and the matrix material. Particularly preferably, it can be provided that the matrix material and the solid material together, based on the carrier material, are present in an amount of ≥97 wt.-%, such as in an amount of 100 wt.-%, so that the carrier material consists of the matrix material and the solid material.

Particularly preferably, the carrier material can consist of at least one polymeric, in particular thermoplastic plastic, for example a plastic mixture as a matrix material, talcum and optionally a bonding agent. In particular, in this embodiment a production can be particularly cost-effective and the process control can be particularly simple.

For example, the carrier material may further comprise a fiber material that, based on the carrier material, is present in an amount of >0 wt.-% to ≤20 wt.-%, in particular from ≥3 wt.-% to ≤12 wt.-%, such as from ≥5 wt.-% to ≤10 wt.-%. With regard to the fiber material, it may be provided that the fiber material comprises fibers which are selected from the group consisting of plant, animal, mineral or even synthetic fibers.

Alternatively, it can be provided for example for wood, in particular for wood flour, that its particle size is between >0 μm and ≤600 μm with a preferred particle size distribution $D_{50}$ of ≥400 μm.

Furthermore, the carrier material may comprise between ≥0 wt.-% and ≤10 wt.-% of other additives, such as flow aids, thermo stabilizers or UV stabilizers.

According to one embodiment of the disclosure, the carrier material may comprise, for example, a matrix material comprising a plastic, a solid material and a fiber material, wherein the solid material is formed of talcum by at least 50 wt.-%, in particular at least 80 wt.-%, in particular at least 95 wt.-%, based on the solid material, wherein the matrix material is present in an amount, based on the carrier material, from ≥20 wt.-% to ≤70 wt.-%, in particular from ≥30 wt.-% to ≤55 wt.-%, in particular from ≥35 wt.-% to ≤45 wt.-%, and wherein the solid material, based on the carrier material, is present in an amount of ≥30 wt.-% to ≤75 wt.-%, in particular from ≥40 wt.-% to ≤65 wt.-%, in particular from ≥45 wt.-% to ≤60 wt.-%, and wherein the fiber material, based on the carrier material, is present in an amount of >0 wt.-% to ≤20 wt.-%, in particular from ≥3 wt.-% to ≤12 wt.-%, such as ≥5 wt.-% to ≤10 wt.-%, and wherein the matrix material, the fiber material and the solid material together, based on the carrier material (20), are present in an amount of ≥95 wt.-%, in particular ≥97 wt.-%.

In this case, it may be preferred that the fiber material comprises fibers which have a length in the range of ≤10 μm, preferably in a range of ≤5 μm, for example in a range from ≥2 μm to ≤5 μm, such as in a range from ≥3 μm to ≤4 μm. It has surprisingly been found that such fibers allow a high stability, which, however, can result in significant advantages during the production. Thus, this embodiment is particularly in contrast to the solutions of the prior art, in which, insofar as fibers were contained in a material, the fibers have a comparatively long length in order to achieve a desired effect. In the prior art usually fiber lengths in the millimeter range were used. Surprisingly, it has been found that, in particular in the predefined embodiment of the carrier material comprising a matrix material, a solid material and a fiber material in the above-described proportions, fibers enable a significant improvement in stability even in the above-described range.

Furthermore, it may be preferred that the fiber material comprises fibers having a diameter or thickness of ≥5 μm to ≤30 μm, for example in a range of ≥7 μm to ≤20 μm. This embodiment, too, can enable a significant improvement in stability, in particular in the previously defined carrier material comprising a matrix material, a solid material and a fiber material in the above-described proportions, wherein a processability is not or not significantly impaired by the presence of the fibers. Thus, even in this embodiment, a very high-quality product without production-specific disadvantages can be enabled.

It may further be preferred that the fiber material comprises fibers selected from the group consisting of plant, animal, mineral or even synthetic fibers. Examples of plant fibers include cellulose fibers, lignose fibers as well as fibers from straw, maize straw, bamboo, leaves, algae extracts, hemp, cotton or oil palm fibers. Examples of animal fiber materials are keratin-based materials such as wool or horsehair. From the aforementioned fibers, for example, cellulose may be of particular advantage. Examples of mineral fiber materials are mineral wool or glass wool. Examples of synthetic fibers include plastic fibers such as fibers of polyester or polytetrafluoroethylene (PTFE). Plant and animal fibers can have the advantage of a particularly good ecological balance, whereas mineral fibers or synthetic fibers may have advantages in terms of heat and moisture resistance.

Insofar as the fiber material comprises synthetic fibers, it may be advantageous that the melting temperature of the plastic fibers is higher than the melting temperature of the matrix material. This embodiment can in turn bring about production-specific advantages. For producing a carrier from the above-defined carrier material, it may be advantageous to melt the carrier material or the matrix material and to form a carrier under pressure, as described below. In this embodiment it can be prevented in such a process, that the plastic fibers also melt, which could least partially eliminate the above-described advantages of the fiber material. Thus, in particular in this embodiment a well processable manufacturing process is possible while ensuring the desired properties. Exemplary plastic fibers include, for example, polytetrafluoroethylene (PTFE).

The edge regions of a panel according to the disclosure can be structured or profiled, in order to provide in particular detachable connecting elements. In this regard, in the case of a profiling in the sense of the disclosure it can be provided that a decorative and/or functional profile is introduced by means of suitable material-removing tools at least in a part of the edges of the decorative panel. A functional profile means, for example, the introduction of a tongue and/or groove profile in an edge to make decorative panels connectable to each other via the introduced profilings. In particular in the case of tongue and/or groove profiles, elastic materials are advantageous, since by sole use thereof profiles can be produced, which are particularly easy to handle and stable. Thus, in particular no further materials are necessary to produce the connecting elements.

A decoration subsurface or primer to be provided according to the disclosure is applied at least on a part of the carrier. For example, initially a primer can be applied as a decoration subsurface in particular for printing processes. This primer may be applied, for example, in a thickness of ≥10 μm to ≤60 μm. In this case, a liquid radiation-curing mixture based on a urethane or a urethane acrylate, optionally with one or more of a photoinitiator, a reactive diluent, a UV stabilizer, a rheology agent such as a thickener, a radical scavenger, a flow control agent, a defoamer or a preservative, a pigment and/or a dye can be used as a primer.

In addition to the primer, a white colored undercoat may be applied. For example, the undercoat may include polyurethane, for example be formed as a polyurethane varnish, and, for example, can be provided with white pigments.

The decoration or the decorative layer can be produced by a printing process, wherein flexographic printing, offset printing or screen printing processes as well as in particular digital printing techniques such as inkjet processes or laser printing processes are suitable. The decorative layer can be formed from an in particular radiation-curable paint and/or ink. For example, a UV-curable paint or ink may be used.

It is also possible, if appropriate, first to carry out a pretreatment of the carrier for electrostatic discharge and, if appropriate, a subsequent electrostatic charging prior to the printing operation. This may in particular serve to avoid the occurrence of blurring in the course of the application of the decoration.

The varnish applied to the decorative layer in order to form a layer of a radiation-curable varnish preferably comprises an acrylate, a diacrylate, a methacrylate, a urethane, urethane acrylate or mixtures thereof. In addition, such a varnish can comprise further components such as in particular a photoinitiator, a reactive diluent, a UV stabilizer, a rheology agent such as a thickener, a radical scavenger, a flow control agent, a defoamer or a preservative, a pigment and/or a dye. Of course, several and/or different of the aforementioned components may be included in such a varnish.

According to one embodiment of the disclosure, it may be provided, for example, that the varnish comprises a diacrylate in a concentration between ≥20 wt.-% and ≤60 wt.-% und a methacrylate in a concentration between ≥1 wt.-% and ≤20 wt. %.

A photoinitiator for radiation-curable varnishes or compositions which can be used in the context of the present disclosure may include, for example, compounds of the group selected from benzophenones such as 4,4-bis(diethylamino)benzophenone, and 3,3',4,4'-tetramethoxybenzophenone, anthraquinones such as t-butylanthraquinones and 2-ethylanthraquinones, thioxanthones such as 2,4-diethylthioxanthone, isopropylthioxanthone and 2,4-dichlorothioxanthone; acetophenones such as diethoxyacetophenone, 2,2-dimethoxyphenylacetophenone, 2-hydroxy-2-methyl-1-phenylpropan-1-one, benzyldimethylketal, 1-hydroxycyclohexylphenylketone, 2-methyl-2-morpholino(4-methylthiophenyl)propan-1-one, 2-methyl-1-(4-methylthiophenyl)-2-morpholino-propan-1-one, 2-benzyl-2-dimethylamino-1-(4-morpholinophenyl)-butanone and trichloroacetophenone; benzoin ethers such as benzoin methyl ether, benzoin ethyl ether, benzoin isopropyl ether and benzoin isobutyl ether; acylphosphine oxides such as 2,4,6-trimethylbenzoyldiphenylphosphine oxides, bis(2,6-dimethoxybenzoyl)-2,4,4-trimethylpentylphosphine oxides and bis(2,4,6-trimethylbenzoyl)-phenylphosphine oxide, methylbenzoyl formate, 1,7-bisacridinylheptane, 9-phenylacridine and azo compounds such as azo-bis-isobutyronitrile, diazonium compounds, and tetracene compounds.

A photoinitiator can, for example, be included in the varnish composition in a concentration between 0.5 and 5 wt.-%.

According to one embodiment of the disclosure, the structured plastic film may consist of a plastic which is selected from the group consisting of polypropylene (PP), polyethylene (PE), polyethylene terephthalate (PET), polycarbonate (PC), polybutylene terephthalate (PBT), a polytrimethylene terephthalate (PTT), a copolymer or a block copolymer thereof.

The plastic film preferably has a thickness between >60 μm and ≤500 μm, preferably between ≥80 μm and ≤350 μm, in particular between ≥100 μm and ≤300 μm, such as 120 μm, 140 μm, 160 μm, 180 μm, 200 μm, 220 μm, 240 μm, 260 μm or 280 μm. Such a thickness has proven to be particularly suitable with regard to the handling in the production process of the decorative panel as well as the haptic impression that can be achieved therewith.

According to a further preferred embodiment, the structured plastic film has an embossing depth between 60 μm and 180 μm. In particular, it is advantageous if the embossing depth is less than the layer thickness of the plastic film. Here, the layer thickness is to be understood as the strength of the film in unembossed areas.

According to a further preferred embodiment of the disclosure, the embossing depth is between 25% and 65% of the layer thickness of the plastic film.

According to one embodiment of the disclosure, the varnish applied onto the structured plastic layer for forming a topcoat layer comprises an acrylate, a diacrylate, a methacrylate, a urethane, urethane acrylate or mixtures thereof. In addition, such a varnish may include further components, in particular a photoinitiator, a reactive diluent, a UV stabilizer, a rheology agent such as a thickener, a radical scavenger, a flow control agent, a defoamer or a preservative, a pigment and/or a dye. Of course, several and/or different of the aforementioned components may be included in such a varnish.

According to a further embodiment of the disclosure it may be provided that the topcoat layer is formed from a plurality of varnish layers or is formed by a multiple application of varnish compositions of the same or of different compositions. Here, it can also be provided that at least one varnish layer or a varnish coating comprises a varnish composition which includes a hard material such as titanium nitride, titanium carbide, silicon nitride, silicon carbide, boron carbide, tungsten carbide, tantalum carbide, alumina (corundum), zirconium oxide or mixtures thereof in order to increase the wear resistance of the layer formed. Likewise, it can be provided that at least one varnish layer or a varnish coating comprises a varnish composition which includes a solid, for example glass beads, glass ellipses or even cellulose fibers in order to increase the wear resistance of the layer formed. It can also be provided that a varnish layer or a varnish coating comprises a varnish composition which includes both hard materials and a solid of the aforementioned type.

Regarding the method, the object of the present disclosure is achieved by a method for producing a decorated or surface-decorated wall or floor panel, comprising the steps:

a) providing a carrier of a plastic composite material;
b) applying a primer layer onto a surface of the provided carrier;
c) applying a decorative layer onto the primer layer applied in step b) by means of a direct printing method;
d) applying a layer of a radiation-curable varnish onto the decorative layer applied in step c); subsequently either
e1) applying a structured or non-structured plastic film onto the not yet or not yet completely cured layer of the radiation-curable varnish applied in step d);
e2) curing of the layer of a radiation-curable varnish applied in step d) by the action of suitable electromagnetic radiation or cooling, wherein the plastic film applied in step e1) is bonded to the remaining layer structure;
e3) structuring the non-structured plastic film applied in step e1) by means of an embossing means for forming a structured plastic film; or
e1') applying a structured plastic film onto the not yet or not yet completely cured layer of the radiation-curable varnish applied in step d);
e2') curing the layer of the radiation-curable varnish applied in step d) by the action of suitable electromagnetic radiation or cooling, wherein the plastic film applied in step e1') is bonded to the remaining layer structure; subsequently
f) applying at least one covering layer of a radiation-curable varnish onto the structured plastic film; and
g) curing the at least one covering layer applied in step f).

In the sense of the present disclosure, a non-structured plastic film is to be understood as a not completely or only partially structured plastic film which receives an additional structuring in the course of the further process.

In the sense of the present disclosure, an incompletely cured layer of the radiation-curable varnish applied in step d) is one which has already been gelled by suitable measures, such as the action of electromagnetic radiation of low intensity and/or short duration, but is not yet fully cured and thus still includes radically polymerizable components.

Prior to the application of the primer layer onto a surface of the provided carrier, it may be provided that the corresponding surface of the carrier is pretreated by means of a corona and/or plasma treatment. As a result, an improved adhesion of the primer layer to the surface can be achieved.

The application of the primer layer can be implemented, for example, by means of rollers, such as rubber rollers, by means of doctor blades, by means of pouring devices, by means of spraying devices or by a combination of the aforementioned devices.

For applying the decorative layer onto the primer layer applied in step b) by means of a direct printing method, in particular flexographic printing, offset printing or screen printing processes, as well as in particular digital printing techniques such as inkjet processes or laser printing processes are suitable.

Subsequent to the application of the decorative layer, a layer of a radiation-curable varnish is applied. The application of this varnish layer can take place, for example, by means of rollers, such as rubber rollers, by means of doctor blades, by means of pouring devices, by means of spraying devices or by a combination of the aforementioned devices.

Optionally, it may be provided according to the disclosure that the applied varnish layer is partially cured by the action of electromagnetic radiation, such as UV radiation or microwave radiation, wherein this partial curing is carried out with the proviso that the applied layer still has a residual fluidity and is not fully cured.

Following the varnish application a structured or non-structured plastic film is applied onto the still flowable varnish bed. This can be done for example by means of a calender in a calendering step. In this case, the plastic film can be at least partially pressed into the varnish bed. Here, preferably the application of the plastic film is implemented while avoiding the inclusion of air bubbles between the varnish layer and the plastic film.

After the application of the plastic film onto the varnish layer, the layer is cured by the action of suitable electromagnetic radiation, whereby the film applied thereon is firmly bonded to the layer structure obtained up to that point.

According to one embodiment of the method, an embossing roller, an embossing plate or an embossing die having an embossing depth which is smaller than the thickness of the plastic film applied in step e1) are used as an embossing means in step e3). In particular, it may be provided that the embossing means has an embossing depth between 25% and 65% of the layer thickness of the plastic film.

Preferably, the embossing takes place under the action of heat. To this end, it may be provided that the plastic film is heated at least at the surface by means of suitable devices, such as IR emitters. It can also be provided that the embossing means is heated by means of suitable means. Finally, moreover a combination of these options can be provided, in which both the plastic film is preheated by means of e.g. IR emitters and then a structure is embossed into the plastic film by use of appropriately heated embossing means.

Preferably, the heat action is controlled so that the plastic film is heated to a temperature in the range between 30% and 80%, preferably between 40% and 70%, of the melting temperature of the plastic film material. It has been shown that with such a heating rate, a good embossing result can be achieved without substantially adversely affecting the durability of the film.

Thus, it can be provided, for example, that when using a PET film, the heat action is controlled so that a surface temperature of the film of 130° C. is not exceeded.

According to one embodiment of the disclosure, it may be provided that prior to the embossing of the applied plastic film an embossing varnish is applied thereon, which has sufficient flexibility to be co-embossed in a subsequent embossing step. Such an embossing varnish is preferably likewise a radiation-curable varnish composition.

According to one embodiment of the disclosure, it may be provided that for producing a surface structure a structural varnish is applied, which substantially corresponds to the embossing varnish described above. The structural varnish is likewise preferably a radiation-curable varnish or a radiation-curable varnish composition. Instead of a structuring by embossing or in addition thereto, it may be provided that the structural varnish applied onto a non-structured plastic film is gelled or partially cured, in the case of a radiation-curable varnish for example by the action of electromagnetic radiation of a suitable wavelength and dose. A haptically perceptible structure can then be produced in the thus gelled or partially cured structural varnish by applying a likewise radiation-curable composition. The application of the radiation-curable composition onto the gelled or partially cured structural varnish can be done, for example, by means of an inkjet process. The drop of the radiation-curable composition applied onto the partially cured structural varnish produces a corresponding deformation of the hitherto smooth surface due to the mechanical action of force at the moment of impact. In addition, the physicochemical properties of the composition applied by the inkjet process such as density, viscosity, polarity or surface tension may be adjusted so that the applied drops partially displace the partially cured or gelled structural varnish. It may be provided, for example, that the structural varnish after a partial curing or gelling has a viscosity in the range of 80-500 mPa*s (at 25°) and the composition applied for structuring has a significantly lower viscosity of 8-30 mPa*s (at 25°). The final curing of both the gelled and partially cured structural varnish and the structure-giving composition may then be done in an immediately subsequent curing step, e.g. by means of UV radiation.

In an alternative embodiment of the method it may be provided that the structure-giving drops applied by means of an inkjet process do not consist of a radiation-curable composition, but of a composition which under the conditions of the application onto the gelled or partially cured structural varnish has a high viscosity and thus a displacement effect with respect to the structural varnish. This is preferably a composition or compound with an atypical thermal transition behaviour, which assumes a gel-like structure at elevated temperature and has the behaviour of a liquid at low temperature.

After the application of such a composition, the structural varnish is cured by the action of radiation. The resulting heating causes the composition to form its gelatinous structure, which forms corresponding patterns in the structural varnish. After curing of the structural varnish layer, the surface may be cooled down to a temperature below the gelation temperature of the composition whereupon the composition can be removed from the surface by simple mechanical means such as a cloth, a brush or vacuuming. An example of substances to form a suitable composition with atypical thermal transient behaviour are poloxamers, e.g. Pluronic F127. This is a triblock copolymer with a hydrophobic poly(propylene oxide) segment (PPO) and two hydrophilic poly(ethylene oxide) (PEO) segments which bond to the PPO segment on both sides while forming a PEO-PPO-PEO sequence. This material gels starting from a critical micelle concentration (CMC) of 21 wt.-% at a temperature>10° C. Below this temperature, the gel structure dissolves and the composition becomes liquid. Preferably, a composition which can be applied by means of an inkjet process for structuring may comprise 40 wt.-% of Pluronic F127.

In one embodiment of the disclosure it is provided that the structuring of the plastic film is carried out in congruence with the decorative image in order to haptically support the realistic appearance of the decoration. To this end, it may be provided that the decorative image comprises so-called register marks, by means of which the embossing means or the already structured plastic film are aligned with respect to the decoration in order to ensure a structuring which is synchronous with the decoration.

According to a further embodiment of the disclosure it can be provided that the side of the plastic film facing the carrier is subjected to a corona treatment and/or plasma treatment prior to application onto the not yet or not yet completely cured layer of the radiation-curable varnish applied in step d). As a result, an improvement in the adhesion of the film to the radiation-curable varnish layer can be achieved.

Alternatively or in addition to the corona and/or plasma treatment described above, an adhesive primer can be applied onto the side of the plastic film facing the carrier plate.

According to one embodiment of the disclosure it may be provided to this end, that as an adhesive primer a composition is applied which comprises a swelling agent and/or a solvent suitable for the plastic film material. Such a composition may, for example, comprise acetone, methyl ethyl ketone, ethyl acetate, isobutyl acetate, tetrahydrofuran, dimethyl sulfoxide, sulfolane, acetonitrile, nitromethane, γ-butyrolactone or mixtures thereof.

According to a preferred embodiment, such a composition may, for example, comprise between ≥5 wt.-% and ≤35 wt.-% isobutyl acetate and between ≥2 wt.-% and ≤65 wt.-% methyl ethyl ketone.

According to the disclosure it may be provided that the method according to method steps e2) or e2') or e3) and thus prior to the application of the covering layer in step (f) is interrupted. In this case, a storable intermediate product or semifinished product is obtained, which can be further processed temporally and/or spatially separated from the previous production process by application of the covering layer, optionally with prior structuring. The disclosure thus expressly also encompasses a method for producing such an intermediate product, which then consists of a carrier, a primer layer, a decorative layer, a layer of a radiation-curable varnish disposed on the decorative layer and a plastic film.

Onto the layer composite obtained according to method step e2') or e3) according to the disclosure a topcoat layer of a radiation-curable varnish is applied.

According to a further embodiment of the disclosure, it may be provided that the topcoat layer is formed by multiple application of varnish compositions of the same or of different compositions and accordingly method step f) is carried out repeatedly. Here, it can also be provided that at least one varnish layer or one varnish coating has a varnish composition which comprises hard materials such as titanium nitride, titanium carbide, silicon nitride, silicon carbide, boron carbide, tungsten carbide, tantalum carbide, alumina (corundum), zirconium oxide or mixtures thereof in order to increase the wear resistance of the layer formed. Likewise, it can be provided that at least one varnish layer or a varnish coating has a varnish composition which comprises a solid, for example glass beads, glass ellipses or cellulose fibers in order to increase the wear resistance of the layer formed. Here, it can also be provided that a varnish layer or a varnish coating has a varnish composition which comprises both hard materials and a solid of the aforementioned type.

Finally, in step g), the topcoat layer applied in step f) is cured. In a repetition of step f) in the manner previously described it may be provided that step g) is also repeated, optionally with the proviso that between the repetition of step f) no complete curing of the applied varnish composition takes place, but only a partial curing or gelling, and a final curing is carried out by a correspondingly long and/or intensive action of suitable electromagnetic radiation, such as UV radiation or microwave radiation.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

The disclosure is explained below in detail with reference to the figures and an exemplary embodiment.

Corresponding reference numerals indicate corresponding parts throughout the several views of the drawings.

DETAILED DESCRIPTION

Example embodiments will now be described more fully with reference to the accompanying drawings.

Figure 1:
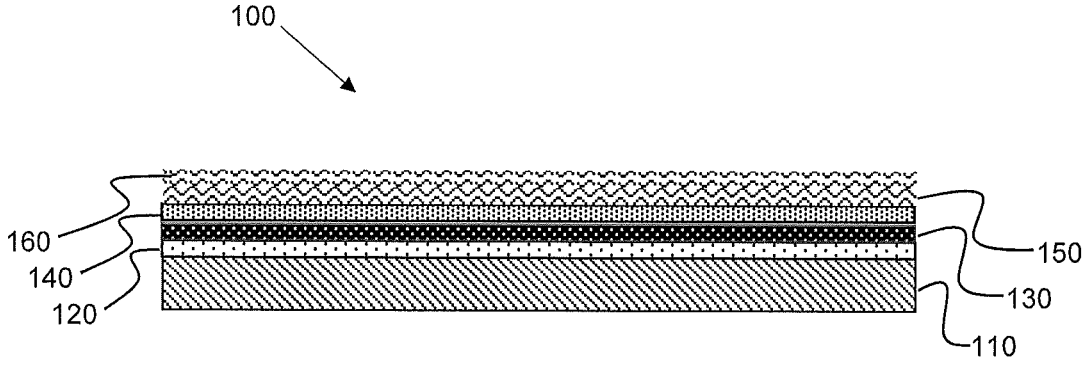
FIG. 1 shows schematically the structure of a decorated and surface-structured wall or floor panel according to the disclosure.

FIG. 1 schematically shows the structure of a decorated and surface-structured wall and/or floor panel 100 according to the disclosure. The panel comprises a carrier 110 preferably made of a plastic composite material. On a surface of the carrier 110 a primer layer 120 is disposed which also can serve as a printing subsurface for the decorative layer 130 disposed thereon. The decorative layer 130 can be applied onto the primer layer 120 by means of a direct printing process such as flexographic printing, offset printing or screen printing processes, and in particular by means of digital printing techniques such as inkjet processes or laser printing processes. On the decorative layer 130, in turn, a layer 140 of a radiation-curable varnish is disposed, by means of which the structured plastic film 150 disposed on the layer 140 is bonded to the layer composite. Above the structured plastic film 150, a topcoat layer 160 is disposed. It may be provided that the topcoat layer 160 comprises hard materials and/or solids and/or fibers for improving the wear resistance. In any case, the topcoat layer is designed such that it does not or not completely level out the surface structure caused by the structured plastic film, so that it is at least partially haptically perceptible at the surface of the wall or floor panel.

Figure 2:
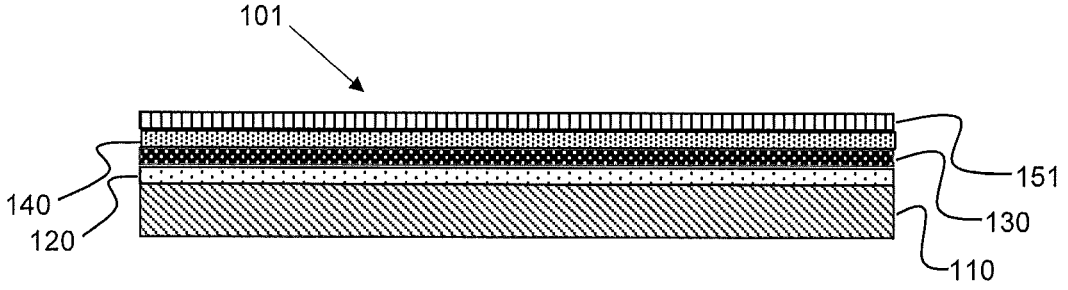
FIG. 2 shows schematically an intermediate product which can be obtained in the context of the method according to the disclosure.

FIG. 2 shows schematically an intermediate product 101, as can be obtained in the context of the method according to the disclosure. Here, the layers 110, 120, 130 and 140 correspond to the layers known from FIG. 1. Instead of an already pre-structured plastic film the intermediate product shown in FIG. 2 comprises a not or not completely structured plastic film 151. In an optional temporally and/or spatially separated further processing step, the surface of the intermediate product 101 formed by the plastic film can be structured by means of suitable embossing means, in particular under the action of heat. In a further optional temporally and/or spatially separated further processing step then a topcoat layer can be applied.

Figure 3:
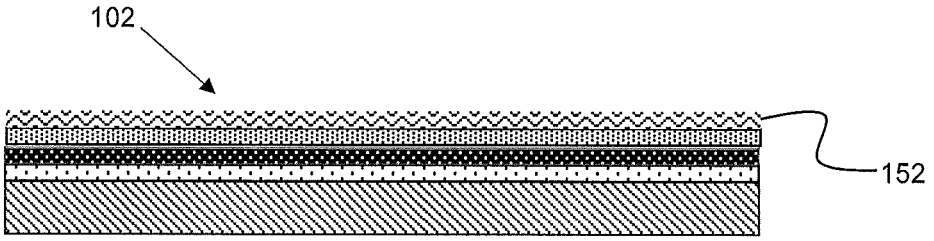
FIG. 3 shows schematically a further intermediate product which can be obtained in the context of the method according to the disclosure.

FIG. 3 shows schematically an intermediate product 102, as can be obtained in the context of the method according to the disclosure. Here, the layers 110, 120, 130 and 140 correspond to the layers known from FIG. 1. The layer 152 represents a structured plastic film in the embodiment shown. It may either be an already pre-structured plastic film or a non-structured plastic film as shown in FIG. 2, which in an optional temporally and/or spatially separated further processing step has been structured by means of suitable embossing means, in particular under the action of heat. In a further optional temporally and/or spatially separated further processing step then a topcoat layer can be applied.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A decorated and surface-structured wall or floor panel comprising:

a carrier made of a plastic composite material;

a primer layer disposed on a surface of the carrier;

a decorative layer disposed on the primer layer;

a layer of a radiation-curable varnish disposed on the decorative layer;

a structured plastic film disposed on the layer of a radiation-curable varnish; and a topcoat layer disposed on the structured plastic film, wherein the carrier comprises a plastic-containing matrix material in which a solid mineral material is embedded.

2. The decorated and surface-structured wall or floor panel according to claim 1, wherein the primer layer comprises a radiation-curing urethane and/or urethane acrylate.

3. The decorated and surface-structured wall or floor panel according to claim 1, wherein the decorative layer comprises at least one radiation-curing ink composition.

4. The decorated and surface-structured wall or floor panel according to claim 1, wherein the varnish applied onto the decorative layer in order to form a layer of a radiation-curable varnish comprises an acrylate, a diacrylate, a methacrylate, a urethane, urethane acrylate or mixtures thereof.

5. The decorated and surface-structured wall or floor panel according to claim 1, wherein the structured plastic film is made of a plastic selected from the group consisting of polypropylene (PP), polyethylene (PE), polyethylene terephthalate (PET), polycarbonate (PC), polybutylene terephthalate (PBT), a polytrimethylene terephthalate (PTT), a copolymer or a block copolymer thereof.

6. The decorated and surface-structured wall or floor panel according to claim 1, wherein the structured plastic film has a thickness between >60 μm and ≤500 μm, preferably between ≥80 μm and ≤350 μm, in particular between ≥100 μm and ≤300 μm.

7. The decorated and surface-structured wall or floor panel according to claim 1, wherein the structures plastic film has an embossing depth between 60 μm and 180 μm.

8. The decorated and surface-structured wall or floor panel according to claim 1, wherein the varnish applied onto the structured plastic film for forming a topcoat layer comprises an acrylate, a diacrylate, a methacrylate, a urethane, urethane acrylate or mixtures thereof.

9. The decorated and surface-structured wall or floor panel according to claim 1, wherein the panel comprises complementary locking means at at least two opposite edges by means of which panels can be joined together in order to form a connected wall or floor covering.

10. A method for producing a decorated and surface-structured wall or floor panel, comprising the steps:

a) providing a carrier made of a plastic composite material;

b) applying a primer layer onto a surface of the provided carrier;

c) applying a decorative layer onto the primer layer applied in step b) by means of a direct printing process;

d) applying a layer of a radiation-curable varnish onto the decorative layer applied in step c); then either e1) applying a non-structured plastic film onto the not yet or not yet completely cured layer of the radiation-curable varnish applied in step d);

e2) curing the layer of a radiation-curable varnish applied in step d) by the action of suitable electromagnetic radiation or cooling, wherein the plastic film applied in step e1) is bonded to the remaining layer structure;

e3) structuring the non-structured plastic film applied in step e1) by an embossing means to form a structured plastic film; or e1') applying a structured plastic film onto the not yet or not yet fully cured layer of the radiation-curable varnish applied in step d);

e2') curing the layer of the radiation-curable varnish applied in step d) by the action of suitable electromagnetic radiation or cooling, wherein the plastic film applied in step e1') is bonded to the remaining layer structure;

subsequently f) applying at least one covering layer of a radiation-curable varnish onto the structured plastic film; and g) curing the at least one covering layer applied in step f).

11. The method according to claim 10, wherein as the embossing means in step e3) an embossing roller, an embossing plate or an embossing die with an embossing depth is used, which is less than the thickness of the plastic film applied in step e1).

12. The method according to claim 10, wherein step e3) is carried out under the action of heat and the heat action is controlled such that the plastic film is heated to a temperature in the range between 30% and 80%, preferably 40% and 70% of the melting temperature of the plastic film material.

13. The method according to claim 10, wherein the side of the plastic film facing the carrier is subjected to a corona treatment and/or a plasma treatment prior to the application onto the not yet or not yet fully cured layer of the radiation-curable varnish applied in step d) and/or an adhesive primer is applied onto the side of the plastic film facing the carrier plate.

14. The method according to claim 13, wherein a composition comprising a swelling agent and/or a solvent suitable for the plastic film material is applied as an adhesive primer.

* * * * *